US009015981B2

(12) United States Patent
Zamlinsky

(10) Patent No.: US 9,015,981 B2
(45) Date of Patent: Apr. 28, 2015

(54) BULLPUP STOCK KIT FOR A RIFLE

(71) Applicant: Aleksey Zamlinsky, Roswell, GA (US)

(72) Inventor: Aleksey Zamlinsky, Roswell, GA (US)

( * ) Notice: Subject to any disclaimer, the term of this patent is extended or adjusted under 35 U.S.C. 154(b) by 107 days.

(21) Appl. No.: 13/914,017

(22) Filed: Jun. 10, 2013

(65) Prior Publication Data

US 2014/0360076 A1 Dec. 11, 2014

(51) Int. Cl.

| | |
|---|---|
| ***F41C 23/20*** | (2006.01) |
| ***F41C 23/06*** | (2006.01) |
| ***F41A 3/66*** | (2006.01) |
| ***F41A 11/02*** | (2006.01) |
| ***F41C 23/22*** | (2006.01) |

(52) U.S. Cl.

CPC ..... *F41C 23/20* (2013.01); *F41C 23/06* (2013.01); *F41A 3/66* (2013.01); *F41A 11/02* (2013.01); *F41C 23/22* (2013.01)

(58) Field of Classification Search

CPC ..... F41A 19/09; F41A 11/02; F41A 19/10; F41A 3/66; F41A 9/65; F41C 23/14; F41C 23/12; F41C 27/22; F41C 23/22; F16B 35/041

USPC ..... 42/49.01, 42.02, 72–75, 75.01, 75.03, 42/69.01; 89/27, 27.3, 136, 132

See application file for complete search history.

(56) References Cited

U.S. PATENT DOCUMENTS

| | | | | |
|---|---|---|---|---|
| 1,307,594 | A | | 6/1919 | Newman |
| 1,909,425 | A | | 5/1933 | Reid |
| 2,457,296 | A | | 12/1948 | Yawman |
| 2,586,317 | A | | 2/1952 | Fay |
| 2,589,227 | A | | 3/1952 | Colley |
| 2,920,413 | A | | 1/1960 | Marhefka et al. |
| 3,184,875 | A | | 5/1965 | Klebe |
| 3,206,884 | A | | 9/1965 | Purvis |
| 3,488,488 | A | | 1/1970 | Crouch |
| 3,611,607 | A | | 10/1971 | Donnell |
| 4,499,683 | A | | 2/1985 | Savioli |
| 4,601,123 | A | | 7/1986 | Swearengen et al. |
| 4,667,429 | A | | 5/1987 | Perazzi |
| 4,677,781 | A | | 7/1987 | Lee |
| 4,685,379 | A | | 8/1987 | Troncoso |
| 4,691,461 | A | | 9/1987 | Behlert |
| 4,803,910 | A | | 2/1989 | Troncoso |
| 4,869,008 | A | | 9/1989 | Rasmussen |
| 5,212,327 | A | * | 5/1993 | Schuemann ..... 42/70.01 |
| 5,780,762 | A | | 7/1998 | Kobayashi |
| 5,797,206 | A | | 8/1998 | Vitorino |
| 6,250,194 | B1 | | 6/2001 | Brandl et al. |
| 6,367,465 | B1 | | 4/2002 | Buccieri, Jr. |
| 6,526,683 | B1 | | 3/2003 | Crandall |

(Continued)

OTHER PUBLICATIONS

Dave Sutherland, SKS Bullpups [online], [retrieved on Aug. 21, 2007], Retrieved from the internet: <URL: http://www.simonov.net/bullpup.htm>.

(Continued)

*Primary Examiner* — Troy Chambers
*Assistant Examiner* — Bridget Cochran
(74) *Attorney, Agent, or Firm* — Asgaard Patent Services, LLC; F. Wayne Thompson, Jr.

(57) ABSTRACT

The present invention provides for a stock kit that converts a conventional rifle, such as an SKS, into bullpup configuration. The preferred embodiment of the provided stock kit does not require any permanent modification be made to the host firearm. The stock kit also provides for a rotatable handguard, trigger safety and a magazine release.

20 Claims, 15 Drawing Sheets

(56) References Cited

U.S. PATENT DOCUMENTS

| | | | | |
|---|---|---|---|---|
| 6,598,329 | B1 | 7/2003 | Alexander | |
| 6,807,763 | B1 | 10/2004 | Leung | |
| 6,901,691 | B1 | 6/2005 | Little | |
| 7,146,762 | B1 | 12/2006 | Leung | |
| 7,231,861 | B1 | 6/2007 | Gauny et al. | |
| 7,356,958 | B2 * | 4/2008 | Weir | 42/69.01 |
| 7,487,768 | B2 | 2/2009 | Hatcher | |
| 8,327,749 | B2 * | 12/2012 | Underwood | 89/138 |
| 8,739,448 | B2 * | 6/2014 | Kimmel et al. | 42/71.01 |
| 8,782,940 | B1 * | 7/2014 | Morris | 42/69.01 |
| 2006/0048425 | A1 | 3/2006 | Frickey | |
| 2006/0048426 | A1 | 3/2006 | Crandall et al. | |
| 2006/0048427 | A1 | 3/2006 | Crandall et al. | |
| 2006/0048429 | A1 | 3/2006 | Crandall et al. | |
| 2006/0048430 | A1 | 3/2006 | Crandall et al. | |
| 2013/0185975 | A1 * | 7/2013 | Johnson | 42/69.02 |

OTHER PUBLICATIONS

Dave Sutherland, SKS Bullpups [online], [archived on Mar. 3, 2001], [retrieved on Aug. 21, 2007], Retrieved from the internet: <URL:http://web.archive.org/web/20010303045437/http://www.simonov.net/bullpup.htm>.

Rifle Tech [online], [retrieved on Aug. 21, 2007], Retrieved from the internet: <URL: http://www.rifletech.net/bullpup.htm>.

Rifle Tech [online], [archived on Dec. 19, 2002], [retrieved on Aug. 21, 2007], Retrieved from the internet: <URL: http://web.archive.org/web/20021219113231/http://rifletech.com/bullpup.htm>.

* cited by examiner

BULLPUP STOCK KIT FOR A RIFLE

BACKGROUND OF THE INVENTION

1. Field of the Invention

This invention generally relates to firearms. More particularly, the present invention relates to stock kits which convert a traditional rifle into bullpup configuration.

2. Description of the Prior Art

Traditionally rifles using detachable magazines are configured so that the action of the firearm and the ammunition magazine are located in front of the trigger. Rifles configured so that the action and the magazine are located behind the trigger of the firearm are referred to as "Bullpups".

Rifles in a bullpup configuration offer several advantages over the more traditional rifle configuration. One of these advantages relates to barrel length. A bullpup having the same overall length as a traditionally configured rifle will have a longer barrel. This is due to the positioning of the action closer to the rear end of the buttstock. Longer barrels are typically associated with increased accuracy and better external and terminal ballistic performance.

While the action and the mounting position of the ammunition magazine are moved towards the rear end relative to the buttstock, the position of the trigger stays relatively the same. This requires a new mechanism to place the trigger and the sear of the firearm's action into operational communication.

In certain instances, end users of more traditional rifles may desire to alter the appearance and functionally of their more traditionally configured rifle into that of a bullpup. This may be done to improve ergonomics, reduce weight, and reduce overall length without compromising ballistic performance. Such a modification would be particularly desirable if it required minimal expertise and mechanical skill.

In addition to a new rifle stock kit for the host firearm, a mechanism to reposition the trigger forward of the action and the magazine must be provided for in order to complete the bullpup conversion.

Therefore in consideration of what is available in the prior art, there exist a need for a rifle stock kit which converts a traditionally configured rifle into bullpup configuration. Such a stock kit should require minimal gunsmithing knowledge or mechanical expertise to install and provide a mechanism to reposition the trigger forward of the action and the magazine.

SUMMARY OF THE INVENTION

In view of the foregoing, one object of the present invention is to meet the recognized need for such an apparatus that converts a traditionally configured rifle into bullpup configuration by providing a rifle stock kit which includes a mechanism for repositioning the trigger.

Another object of the present invention is to provide a rifle stock kit in accordance with the preceding objects which provides for a rotatable handguard that may be used as vertical foregrip.

Yet another object of the present invention is to provide a rifle stock kit in accordance with the preceding objects which provides a mechanism to facilitate removal of the ammunition magazine.

A further object of the present invention is to provide a rifle stock kit in accordance with the preceding objects which provides a trigger safety mechanism.

In accordance with these and other objects, the present invention is directed to a rifle stock kit which is configured to receive the barreled action of a firearm and convert it to a bullpup configuration. The rifle stock kit consists of a three piece chassis system, a mechanical device to connect the trigger provided by the stock kit to the sear of the barreled action, a mechanical trigger safety, a rotatable handguard and a magazine release. The preferred embodiment of the rifle stock kit is configured to work with a SKS type rifle.

The chassis system provided for herein consists of a body portion, top portion and a buttstock portion. The body portion is configured to receive the barreled action of an SKS type rifle. The body portion provides for a pistol grip and trigger that are located in front of the firearm's action and the firearm's magazine. Provided on the pistol grip is a mechanical safety which must be disengaged in order to operate the trigger. The trigger is provided with a mechanical link which extends therefrom back to the action of the SKS, placing the two into operational communication.

Located on the bottom portion of the chassis in front of the trigger is a handguard which is grasped by a users support hand during operation of the firearm. The handguard is rotatable and may be used as a foregrip, sometime referred to as a vertical foregrip.

Located adjacent to the magazine catch present on the action of the SKS is a magazine release lever. The magazine release lever is secured to the bottom portion of the chassis and provides two contact surfaces. By operating either contact surface the magazine may be quickly released.

These together with other improvements and advantages which will become subsequently apparent reside in the details of construction and operation as more fully hereinafter described and claimed, reference being made to the accompanying drawings forming a part hereof, wherein like numerals refer to like parts throughout.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
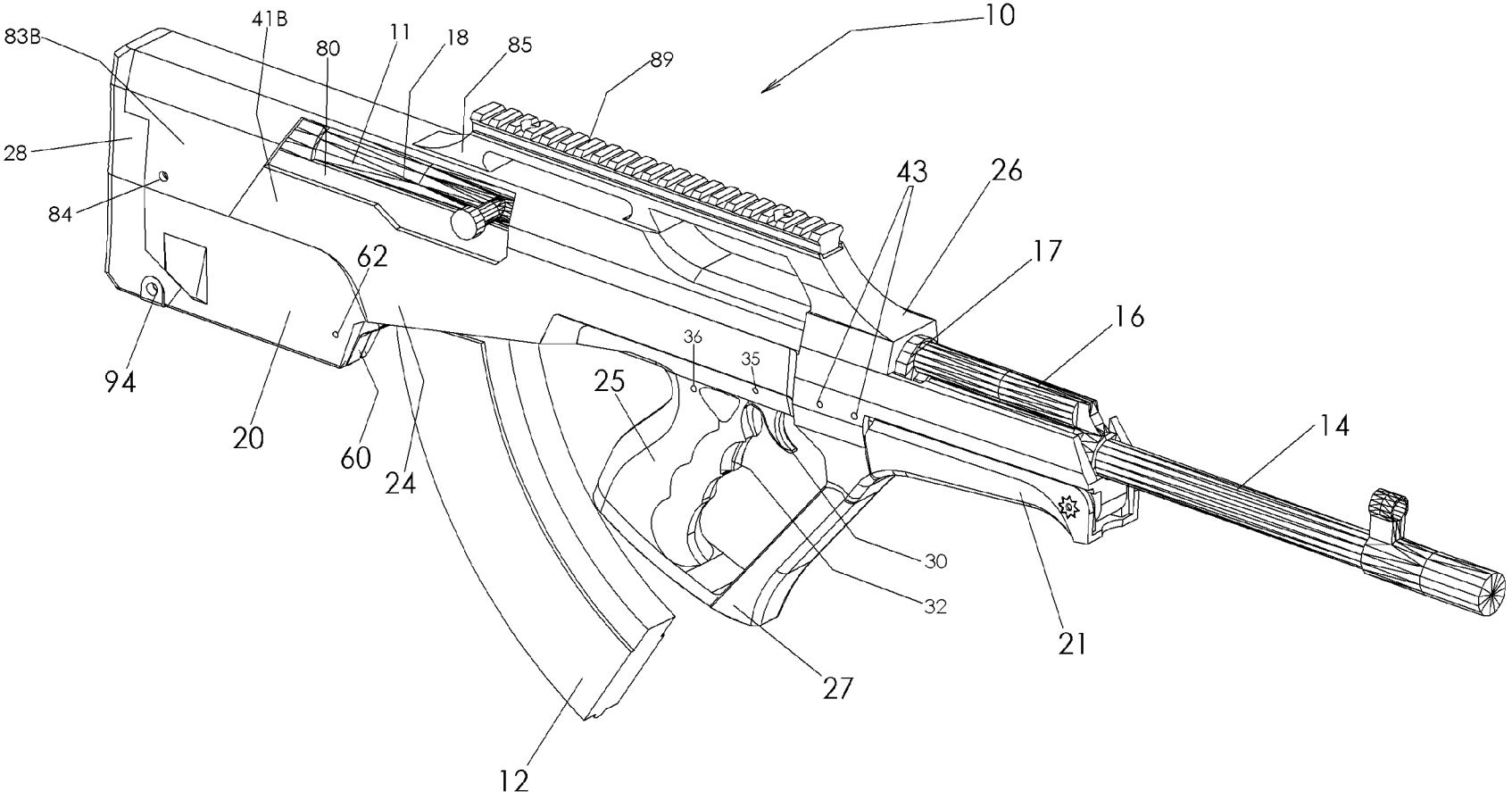
FIG. 1 is a side perspective view of one side of a SKS type rifle's barreled action equipped with a bullpup stock kit in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is directed towards a rifle stock kit that may be used to convert a traditionally configured rifle into bullpup configuration. The rifle stock kit also provides for an integrated rotatable handguard that may be used as a vertical foregrip, a trigger safety and a magazine release. As used herein, the phrases rifle stock kit and bullpup stock kit are used interchangeably.

It is to be understood that the term "action" as used throughout this specification includes the bolt, receiver and trigger mechanism of the firearm used with the preferred embodiment of the present invention. The firearm used with the preferred embodiment is a Samozaryadnyj Karabin sistemy Simonova rifle, commonly referred to as an SKS. The SKS is typically chambered to fire 7.62×39 mm ammunition.

Turning now to the drawings in which like reference characters indicate corresponding elements throughout the several views, as used herein, the word "front" or "forward" corresponds to where the muzzle end of the barrel is located (i.e., to the right as shown in FIGS. 1, 3 and 15-17); "rear" or "rearward" or "back" corresponds to the direction opposite where the muzzle end of the barrel is located (i.e., to the left as shown in FIGS. 1, 3 and 15-17).

Figure 2:
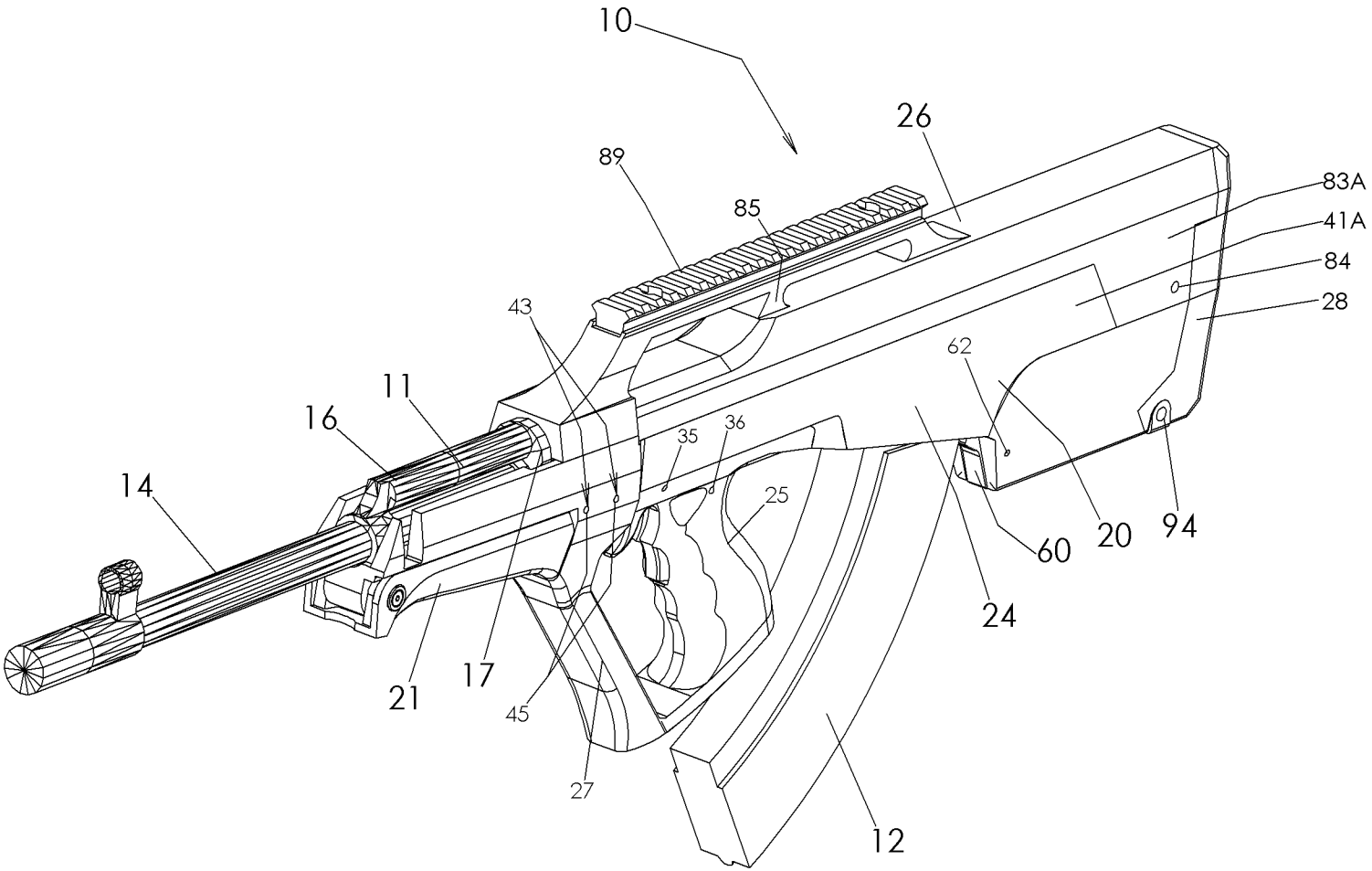
FIG. 2 is a side perspective view of another side of the SKS type rifle shown in FIG. 1.
Figure 15:
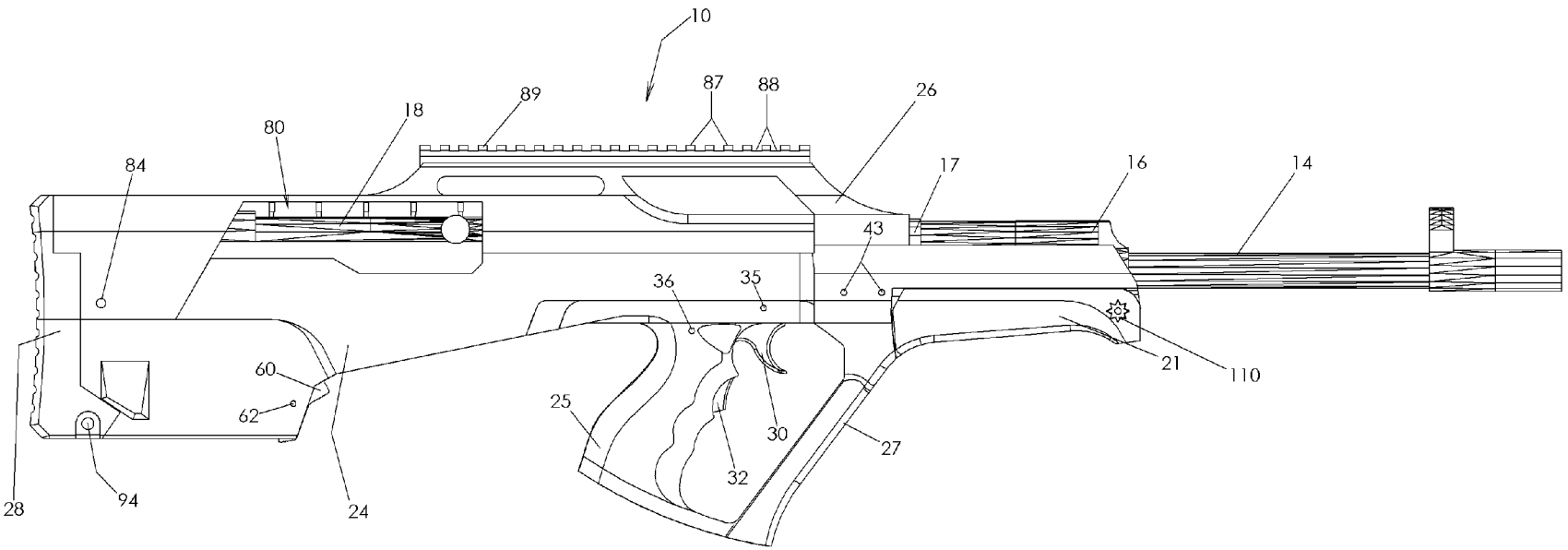
FIG. 15 is a side view of the bullpup shown in FIG. 1.

As shown in FIGS. 1-2 and 15, the present invention is directed to a bullpup stock kit, generally designated by reference numeral 20, for use with the barreled action 11 of an SKS type rifle. The combination of the barreled action 11 and the bullpup stock kit 20 is referred to as the bullpup configured rifle, or simply bullpup, and is designated by reference number 10.

Figure 3:
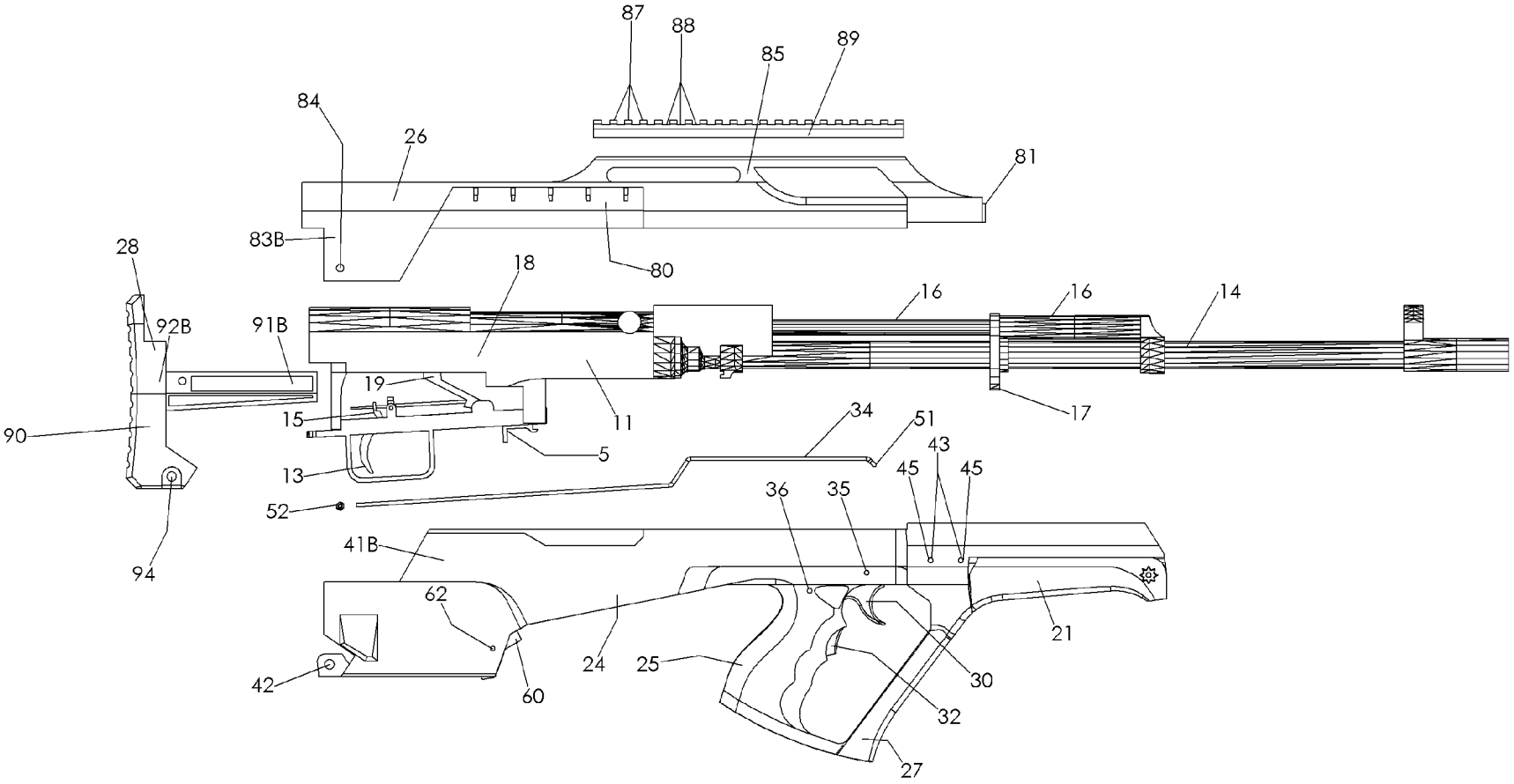
FIG. 3 is an exploded perspective view of the bullpup stock kit assembly including the bottom, top and buttstock portions of the chassis assembly; the linking mechanism of the trigger and the barreled action of an SKS type rifle are also shown.

Best shown in the exploded view of FIG. 3, the bullpup stock kit 20 generally consists of a top portion 26, a body portion 24, a buttstock portion 28, a trigger 30, trigger safety 32, a trigger link 34 and a magazine release lever 60. The combination of the body portion 24, top portion 26 and buttstock portion 28 are collectively referred to herein as the chassis 22. Also shown in FIG. 3 is a detailed view of an SKS rifles barreled action 11. The barreled action 11 is comprised of an action 18 (receiver and bolt), barrel 14, handguard cap 17 and gas tube 16. The action 18 also has a trigger 13, a sear 15, a hammer 19, and a magazine release 5. The magazine release 5 is sometimes referred to herein as a magazine catch.

Figure 4:
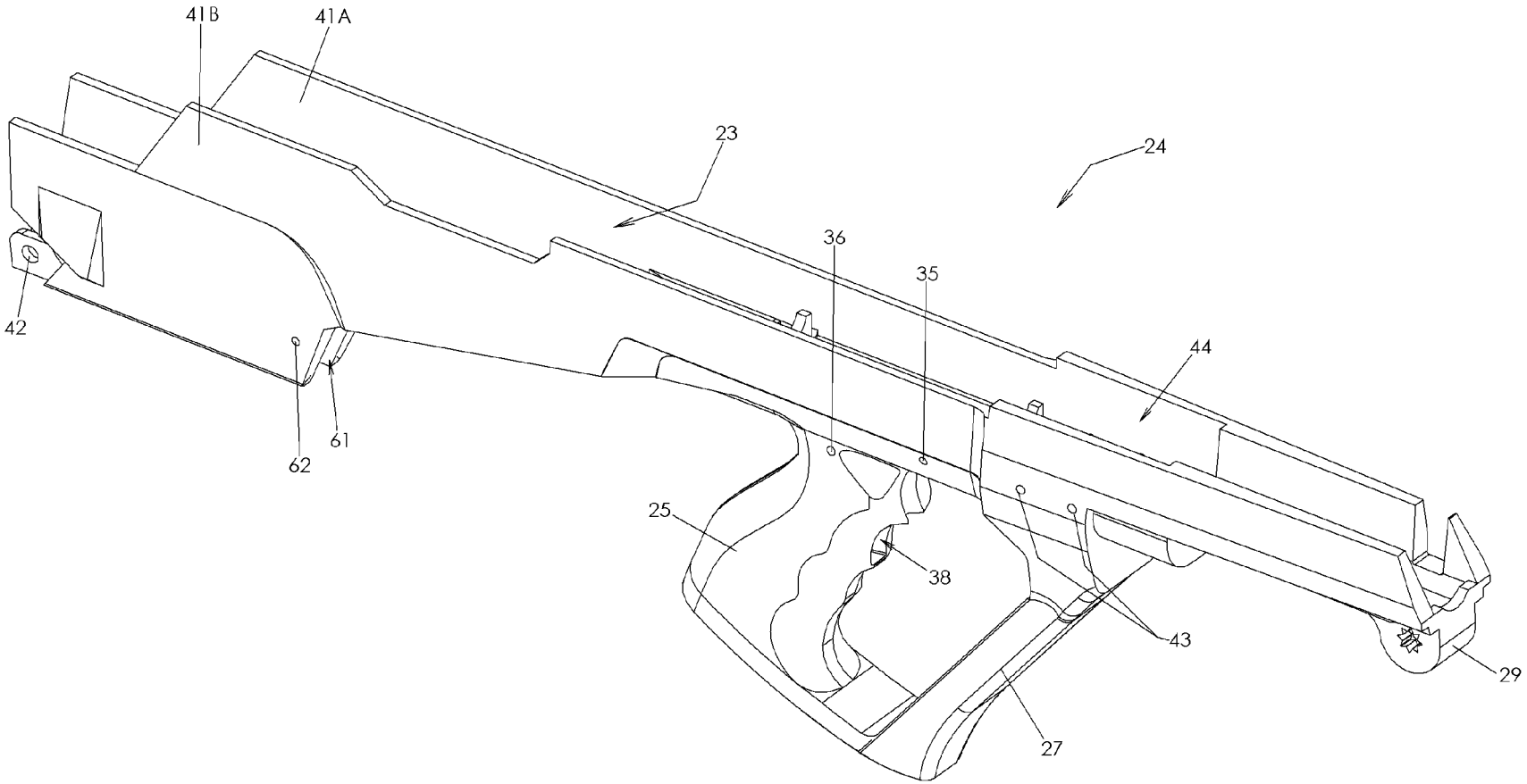
FIG. 4 is a side perspective view of the body portion of the bullpup stock kit's chassis in accordance with the present invention.

A perspective side view of the chassis's 22 body portion 24 is shown in FIG. 4. The chassis 22 is configured to receive the barreled action 11 in a channel 23 which extends between the back of the body portion 24 to its front. The channel 23 defines an interior bottom portion 40 with two side walls 41A and 41B extending therefrom. Side walls 41A and 41B generally occupy parallel plans.

Figure 5:
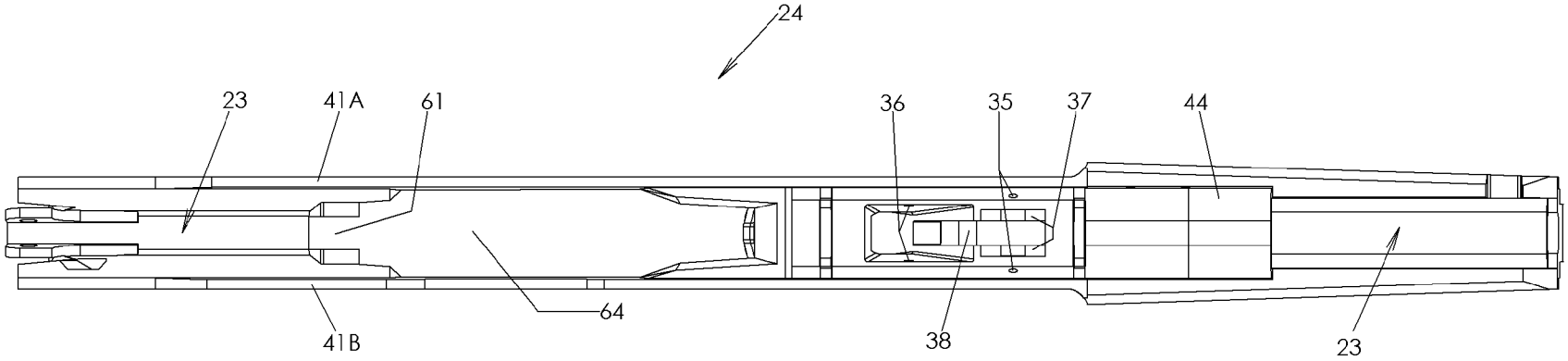
FIG. 5 is a top view of the body portion of the chassis shown in FIG. 4.
Figure 7:
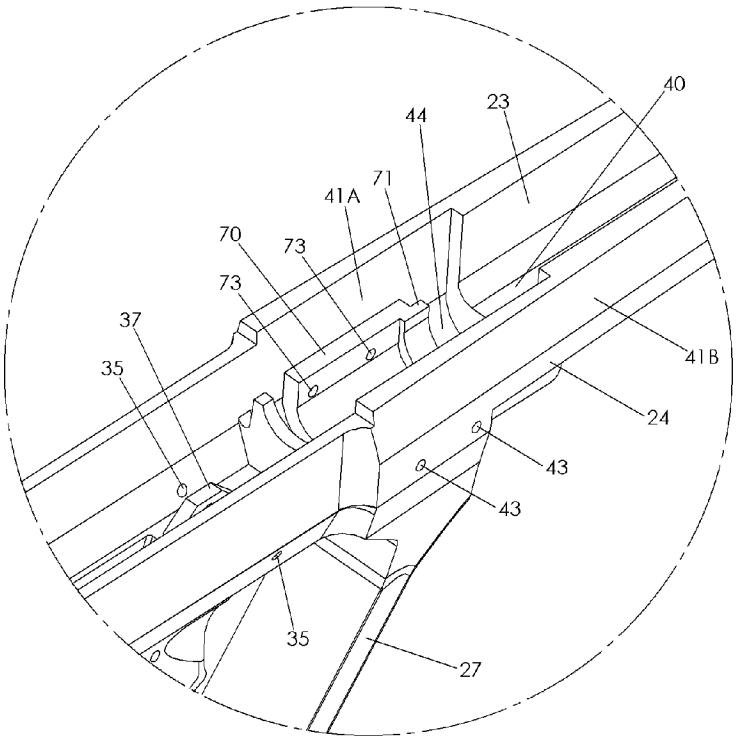
FIG. 7 is an enlarged partial view of FIG. 6 showing how the handguard cap adaptor is received within the body portion of the chassis.
Figure 6:
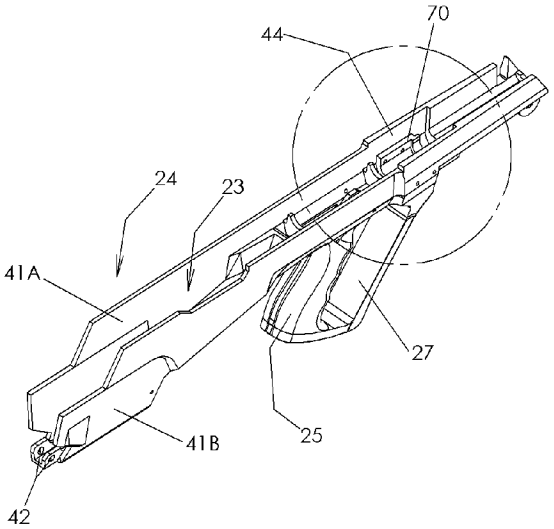
FIG. 6 is a top perspective view of the body portion of the chassis shown in FIG. 4.
Figure 8:
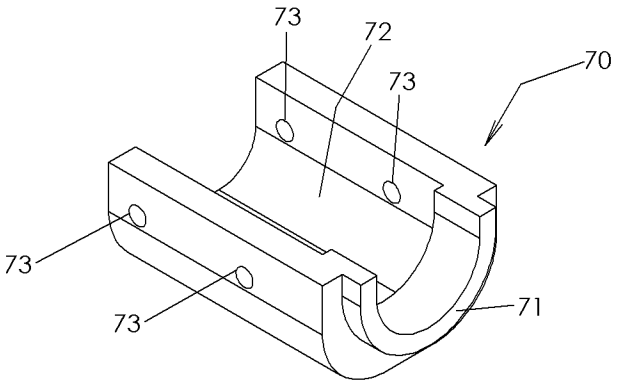
FIG. 8 is a side perspective view of the handguard cap adaptor in accordance with the present invention.
Figure 9:
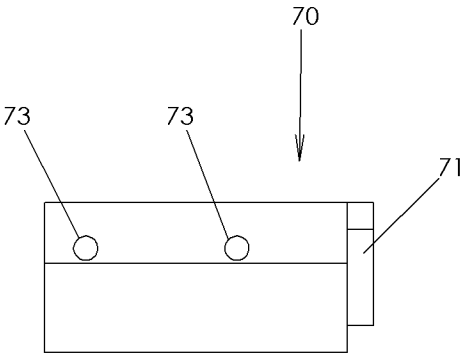
FIG. 9 is a side view of the handguard cap adaptor shown in FIG. 8.

Extending from the bottom side of the body portion 24 is a pistol grip 25 and a trigger guard 27. The pistol grip 25 and trigger guard 27 are connected together. Located on the front end of the body portion 24 is a joint 29 to which the handguard 21 is mounted as shown in FIGS. 1-3 and 15-17. Located on the underside of the body portion 24 near the back end is an opening 61 configured to receive the magazine release 60 lever therein (see FIGS. 1-3). Located adjacent to and connected with the opening 61 for the magazine release lever 60 is an opening 64 configured to receive a portion of the ammunition magazine 12 therein (see FIG. 5). The opening 64 is often referred to as a magazine well. Located adjacent the rear most end of the body portion 24 is a thru-bore 42. The function of which will be described in greater detail in the following paragraphs.

Located on each side wall 41A and 41B, above the trigger guard 27, are two thru-bores 43. The thru-bores 43 located on side wall 41A are in alignment with the thru-bores 43 present on side wall 41B. Located between the thru-bores 43 within the interior of the body portion 24 is a pocket 44 (see FIGS. 4-7). The pocket 44 is configured to receive the handguard cap adaptor 70 described below (see FIGS. 6-9).

Figure 16:
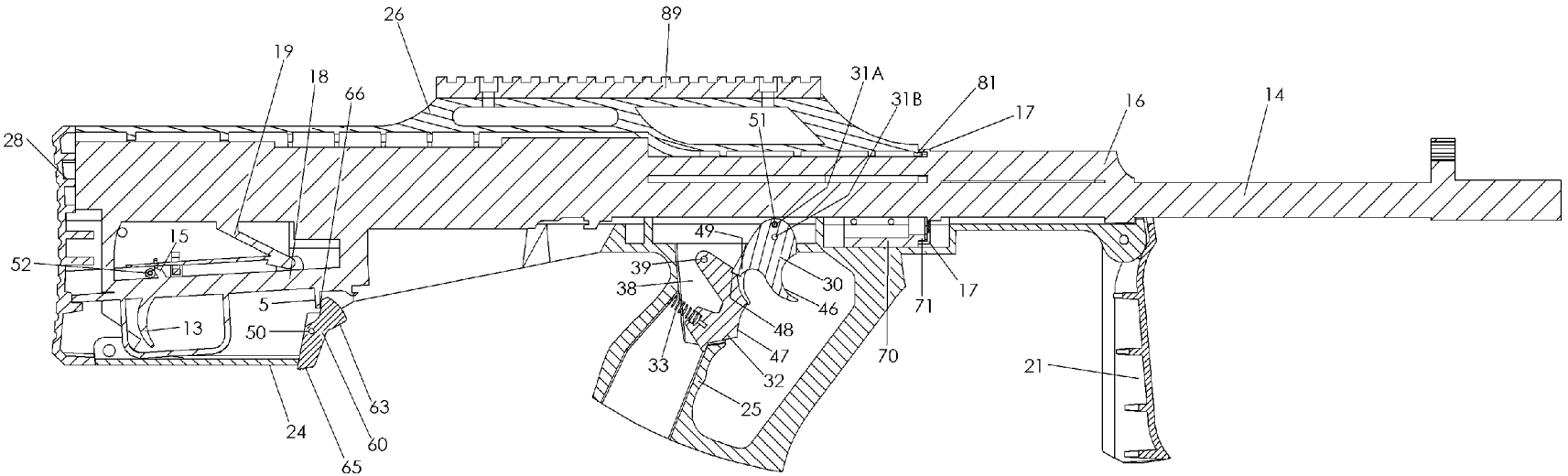
FIG. 16 is a side cutaway view of the rifle shown in FIG. 15, in particular the first position of the trigger safety is shown.
Figure 17:
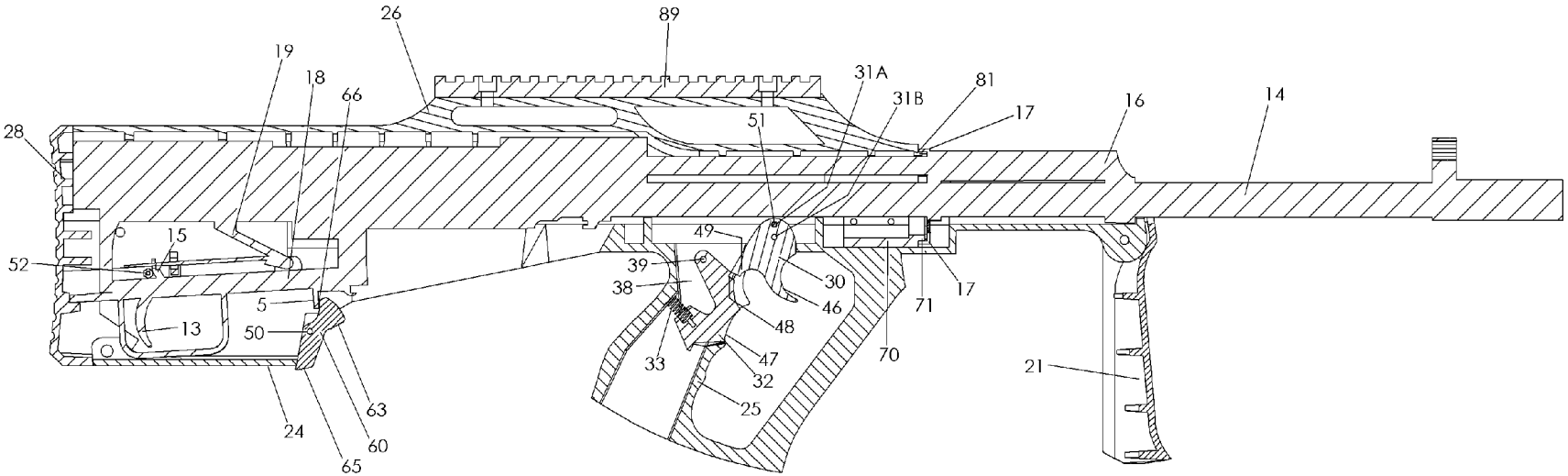
FIG. 17 is a partial cutaway view of the rifle shown in FIG. 15, in particular the second position of the trigger safety is shown.

The handguard cap adaptor 70 has a protruding lip 71 on its front end constructed to be received by a portion of the handguard cap 17 (see FIGS. 16-17). It has an interior channel 72 configured to receive a portion of the barrel 14 therein when the barreled action 11 is secured within the body portion 24 of the chassis 22. Four openings 73 through the top portion of the handguard cap adaptors' 70 body are provided (see FIGS. 7-9). There are two openings 73 on each side of the handguard cap adaptor 70, each opening 73 being in alignment with an opening 73 located on the opposite side of the handguard cap adaptor 70. When the handguard cap adaptor 70 is placed within the pocket 44, the openings 73 are aligned with the thru-bores 42 of the body portion 24 of the chassis 22 (see FIG. 7). Once the openings 73 are in alignment with the thru-bores 42, two roll pins 45 (see FIGS. 2-3) are used to secure the handguard cap adaptor 70 to the body portion 24 of the chassis 22. Alternatively, a screw or friction pin may be used without departing from the scope of the present invention.

When the barreled action 11 is secured within the channel of the body portion 24, a portion of the handguard cap 18 receives therein the protruding lip 71 of the handguard cap adaptor 70 (see FIGS. 16-17).

The pocket 44 is constructed to receive handguard cap adaptors 70 of varying size (see FIGS. 4-7). This is useful because the exact location of the handguard cap 17 on the gas tube 16 as it relates to the action 18 of the firearm varies based on the SKS rifles nation of origin. The overall length of the handguard cap adaptor 70 or the protruding lip 71 may be varied to accommodate the dimensional variations which exist between SKS type rifles manufactured at different arsenals.

Figure 10:
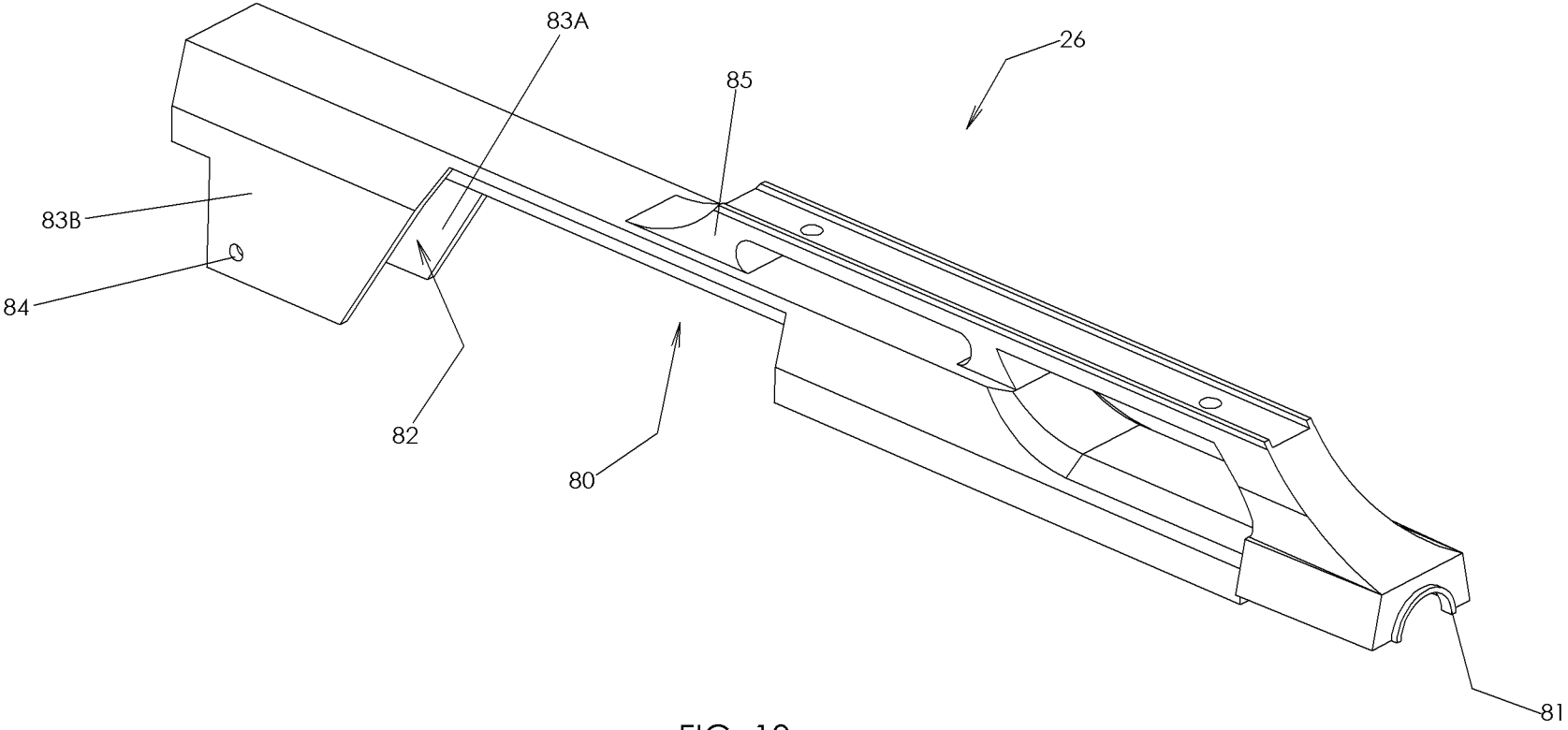
FIG. 10 shows a side perspective view of the chassis's top portion in accordance with the present invention.

FIG. 10 shows a side perspective view of the chassis 22 top portion 26. The top portion 26 has an ejection port opening 80 which allows the user to operate the action 18 of the bullpup 10 and facilitates the ejection of spent ammunition cases during firing (see FIGS. 1, 3, 10 and 15). Located on its forward most end is a protruding lip 81. The protruding lip 81 has a generally "U" shape, similar to the protruding lip 71 of the handguard cap adaptor 70.

The top portion 26 defines an interior opening 82 configured to fit around a portion of the barreled action 11. Two side walls 83A and 83B are provided on the back end of the top portion 26. Each side wall 83A and 83B defines an opening 84 therethrough which is in alignment with an opening 84 in the other side wall 83A and 83B.

The top side of the chassis's 22 top portion 26 includes an elevated mounting platform 85 (FIG. 10). Secured to the elevated mounting platform 85 is a rail segment 89 (see FIGS. 1-3 and 15-17). The rail segment 80 includes a number of rails extending therealong separated by traverse grooves 88 therebetween (see FIGS. 3 and 15). In the illustrated embodiment, the rail segment 89 of the elevated mounting platform 85 is manufactured in accordance with the MIL-STD-1913 rail specifications. The rail segment 89 facilitates the attachment of iron sights and/or optical gun sights based on user preference. Other attachment surfaces which facilitate the attachment of optics and iron sights could be used in place of the rail segment 89 shown and described herein. In the preferred embodiment, the rail segment 89 is secured to the elevated mounting platform 85 through the use of screws.

Figure 12:
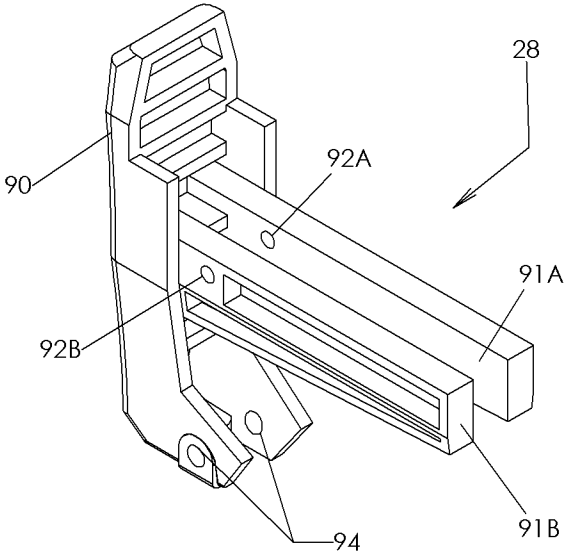
FIG. 12 is a side perspective view of the buttstock shown in FIG. 11.
Figure 11:
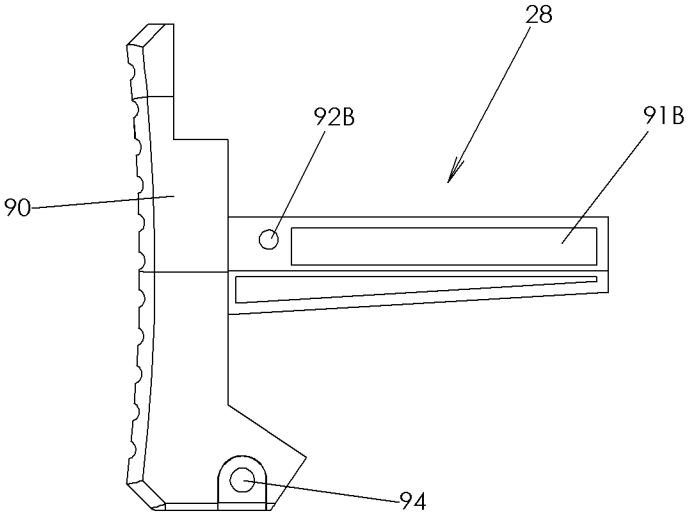
FIG. 11 is a side view of the chassis buttstock portion in accordance with the present invention.

FIGS. 11 and 12 show detailed illustrations of the chassis's 22 buttstock portion 28. The back side 90 defines thereon a textured surface which prevents the bullpup 10 from slipping off of the users shoulder during firing. Extending from the back side 90 of the buttstock portion 28 are two arms 91A and 91B. Each of the arms 91A and 92B are configured to interface with the body portion 24 and top portion 26 of the chassis 22. Near the proximal end of each arm 91A and 91B is an opening 92A and 92B, respectively. Also provided on the buttstock portion 28 is a thru-bore 94, the purpose of which will be later described in detail.

The arms 91A and 92B are constructed to be received within an interior opening which is present after the body portion 24 and the top portion 26 of the chassis 22 are attached to the barreled action 11 during assembly.

Figure 13:
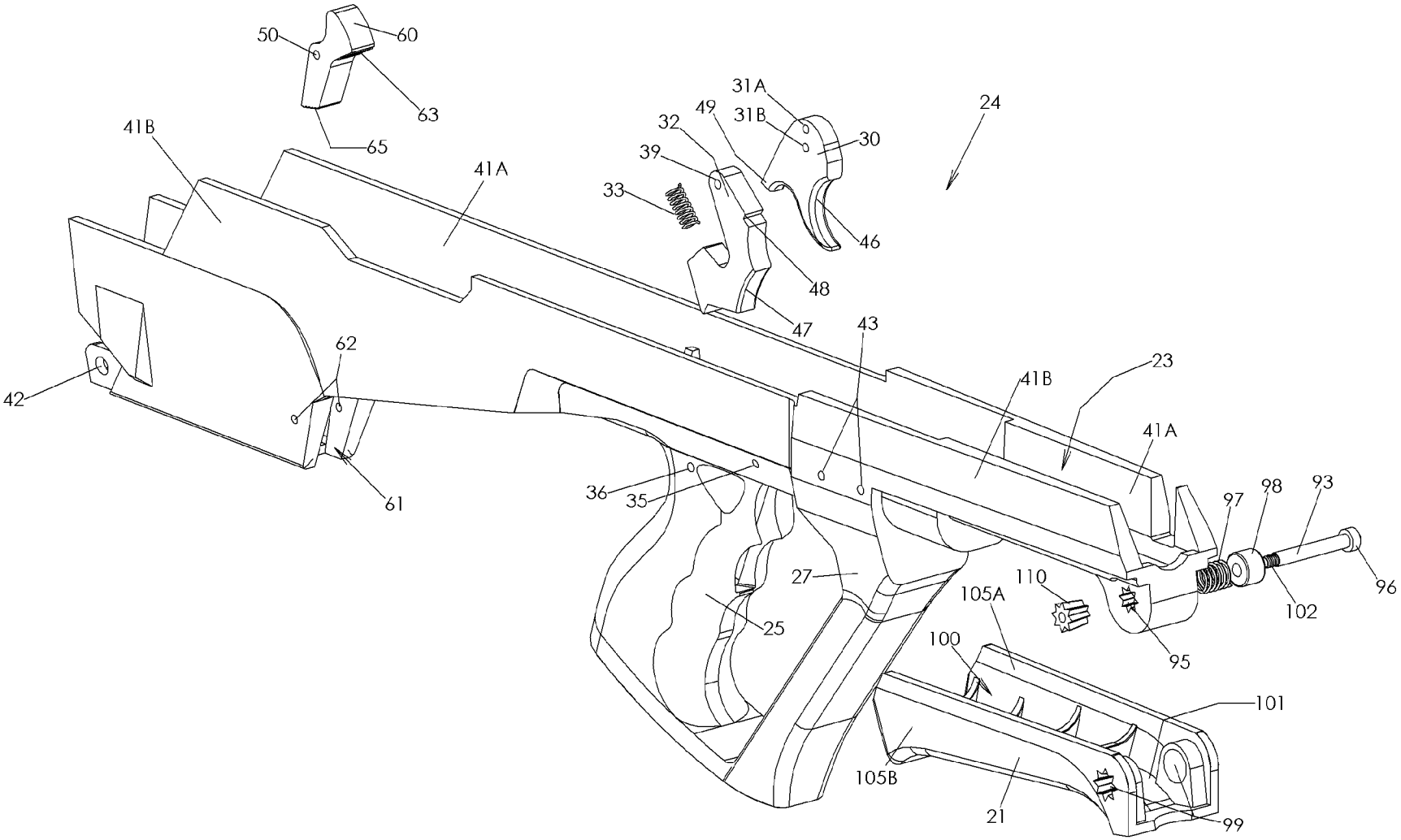
FIG. 13 is an exploded side view of the body portion showing the rotatable handguard, trigger, trigger safety and magazine release in accordance with the present invention.
Figure 14:
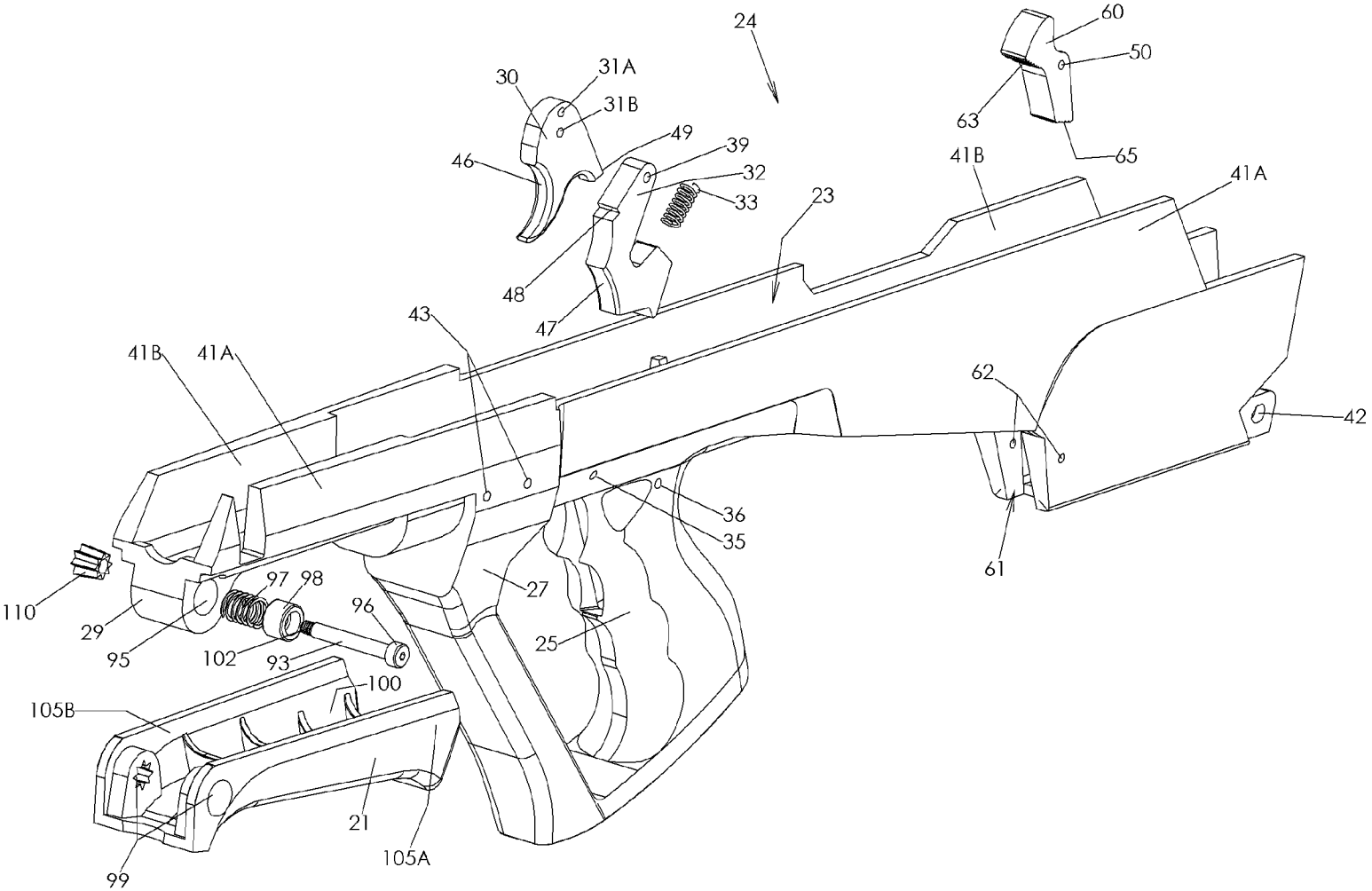
FIG. 14 is an exploded side view of another side of the body portion shown in FIG. 13.

FIGS. 13 and 14 show exploded views of the body portion's rotatable handguard 21. The joint 29 has an opening 95 therethrough configured to receive a pin 93 (FIGS. 4 and 13-14). The opening 95 has an eight side star-shaped opening on one end which has tapered interior side walls and a generally circular opening on the other end. The pin 93 has a head 96 portion, a threaded portion 102 and a cylindrical body portion extending therebetween. The preferred embodiment pin 93 is a shoulder bolt. Also provided are a coil type spring 97, a star-shaped locking piece 110 having a threaded interior opening and tapered exterior side walls and an end button 98 having a centrally located opening therethrough.

The rotatable handguard 21 is configured to be grasped by the user during use of the bullpup 10. The preferred embodiment handguard 21 is also constructed so that it may be rotated and used as a vertical foregrip. Located on its forward end is an opening 99 which extends through sides walls 105A and 105B. The portion of opening 99 on side wall 105B has the general shape of an eight point star, the interior side walls of which are tapered. The portion of opening 99 on side wall 105A is generally circular (see FIGS. 13 and 14). The handguard 21 defines an interior 100 area configured to be received against the body portion 24 when in the closed position (see FIGS. 1-4).

To attach the handguard 21 to the body portion 24, the gap 101 of the handguard 21 located generally between side walls 105A and 105B is placed about the joint 29 of the body portion 24. When the joint 29 is within the gap 101, opening 95 and opening 99 are in alignment with each other. The spring 97 and end button 98 are then placed within the circular portion of opening 99. The star-shaped locking piece 110 is inserted into the star-shaped portions of opening 99 and 95, respectively. The pin 93 is then inserted through the aligned openings 95 and 99 and threadedly secured to the star-shaped locking piece 110 (see FIGS. 13 and 14). The end button 98 holds the spring 97 in place when the pin 93 is threadedly secured to the star-shaped locking piece 110.

The star-shaped locking piece 110 secures the handguard 21 against unintentional movement when it is seated within opening 95 and 99. The foregrip 21 may be disassembled by reversing the above outlined steps.

By varying the shape of the locking piece 110 and the appropriate portions of openings 95 and 99, the number of positions into which the handguard 21 may be moved can be varied. The preferred embodiment of the handguard is provided with at least three positions of use.

The foregrip 21 may be placed in a closed position, also referred to as a first position, as shown in FIGS. 1-4. In its closed position, the rotatable handguard 21 acts as a conventional handguard. Alternatively, the handguard 21 may be rotated to a second or third position where is acts as a foregrip. The second position places the length of the handguard at an approximate 45 degree angle as it relates to the longitudinal axis of the body portion 24 of the chassis 22. The third position places the handguard 21 into a vertical position where it is at an approximately 90 degree angle in relationship to the chassis's 22 body portion 24 (see FIGS. 15-17).

The rotatable handguard 21 is moved between positions by pressing side wall 105A towards the body portion 24. This action compresses spring 97 and causes the star-shaped locking piece 110 of pin 93 to be pushed out of engagement with the star-shaped portion of opening 95. The handguard 21 is the free to rotate to the next provided position at which time the pressure being placed on side wall 105A is released. Once pressure is release from side wall 105A the star-shaped locking piece 110 is received within another portion of the star-shaped portion of opening 95. Once the star-shaped locking piece 110 has been received within the star-shaped portion of opening 95 the handguard is secured against unintentional movement.

The trigger 30 and trigger safety 32 provided by the bullpup stock kit 20 are mounted to the body portion 24 of the chassis 24 (see FIGS. 1-3). The trigger 30 has two thru-bores 31A and 31B there through and defines a contact surface 46 thereon (see FIGS. 13-14). The trigger safety 32 has one thru-bore 39 there through and defines a contact surface 47 thereon (see FIGS. 13-14). The contact surfaces 46 and 47 of the trigger 30 and trigger safety 32, respectively, are preferably textured.

The body portion 24 of the chassis 22 provides two openings 35 and 36 therethrough for mounting the trigger 30 and trigger safety 35, respectively (see FIGS. 1-5 and 13-14). Opening 36 also passes through the structure 37, or mounting position, provided within the interior channel 23 of the body portion 24. The provided structure 37 is constructed to receive the trigger 30 therein and minimize its side to side movement during operation (see FIGS. 5 and 7).

The pistol grip 25 portion of the chassis 22 has a hollow 38 therein configured to receive the trigger safety 32, trigger safety spring 33, and a portion of the trigger 30 (see FIGS. 4-5 and 16-17). The trigger safety 32 has a fist position of operation shown in FIG. 16 and a second position of operation shown in FIG. 17.

The spring 33 biases the trigger safety 32 into the first position. The first position of the trigger safety 32 has the safety sear 48 engaged with a rearwardly protruding member 49 of the trigger 30. This engagement between the safety sear 48 and protruding member 49 prevents the rearward movement of the trigger 30 (see FIG. 16).

When the contact surface 47 of the trigger safety 32 is depressed towards the back side of the pistol grip 25, the safety sear 48 is rotated out of engagement with the protruding member 49 of the trigger 30. This is called the second position of the trigger safety 32 (see FIG. 17). In this position, if the trigger 30 contact surface 47 is acted on by the user, the trigger 30 will move towards the rear allowing the bullpup 10 to be fired.

Another portion of the bullpup stock kit 20 is the magazine release lever 60 (see FIGS. 1-3 and 15-17). The magazine release lever 60 has a thru-bore 50 located near its approximate center. Located on its forward face, near its top, is a textured contact surface 63. Located adjacent its bottom surface is another contact surface 65. Located opposite the contact surface 63 on the forward face of the magazine release lever 60 is the engagement surface 66 (see FIGS. 16-17).

When the magazine release lever 60 is attached to the body portion 24 of the chassis 22, the engagement surface 66 is in contact with the magazine release 5 of the action 18. When the contact surface 63 of the magazine release lever is depressed, the engagement surface 66 pushes the magazine release 5 of the action 18 towards the rear of the rifle 10 allowing the magazine 12 to be removed.

Alternatively, the user may push the contact surface 65 provided on the bottom of the magazine release lever 60 forward. This motion causes the engagement surface 66 of the magazine release lever 60 to push the magazine release 5 of the action 18 towards the rear. The magazine 12 may be removed from the bullpup 12 once the magazine release 5 has been moved sufficiently towards the rear.

The magazine 12 is secured within the magazine well of the chassis 22, to the barreled action 11 in a manner well known throughout the prior art as it concerns SKS type firearms. In alternate embodiments of the bullpup stock kit 20, the method of securing a magazine into place will vary according to the barreled action used.

The magazine release lever 60 is secured to the body portion 24 of the chassis 22 as follows. The magazine release lever 60 is inserted into the opening 61 provided in the body portion 24. The thru-bore 50 of the magazine release lever 60 is aligned with the opening 62 provided on the body portion 24 of the chassis 22. When the thru-bore 50 is aligned with the opening 62, a friction pin is inserted through the aligned openings thereby securing the magazine release lever 60 in place. The friction pin provides a surface about which the magazine release lever 60 rotates.

Figure 18:
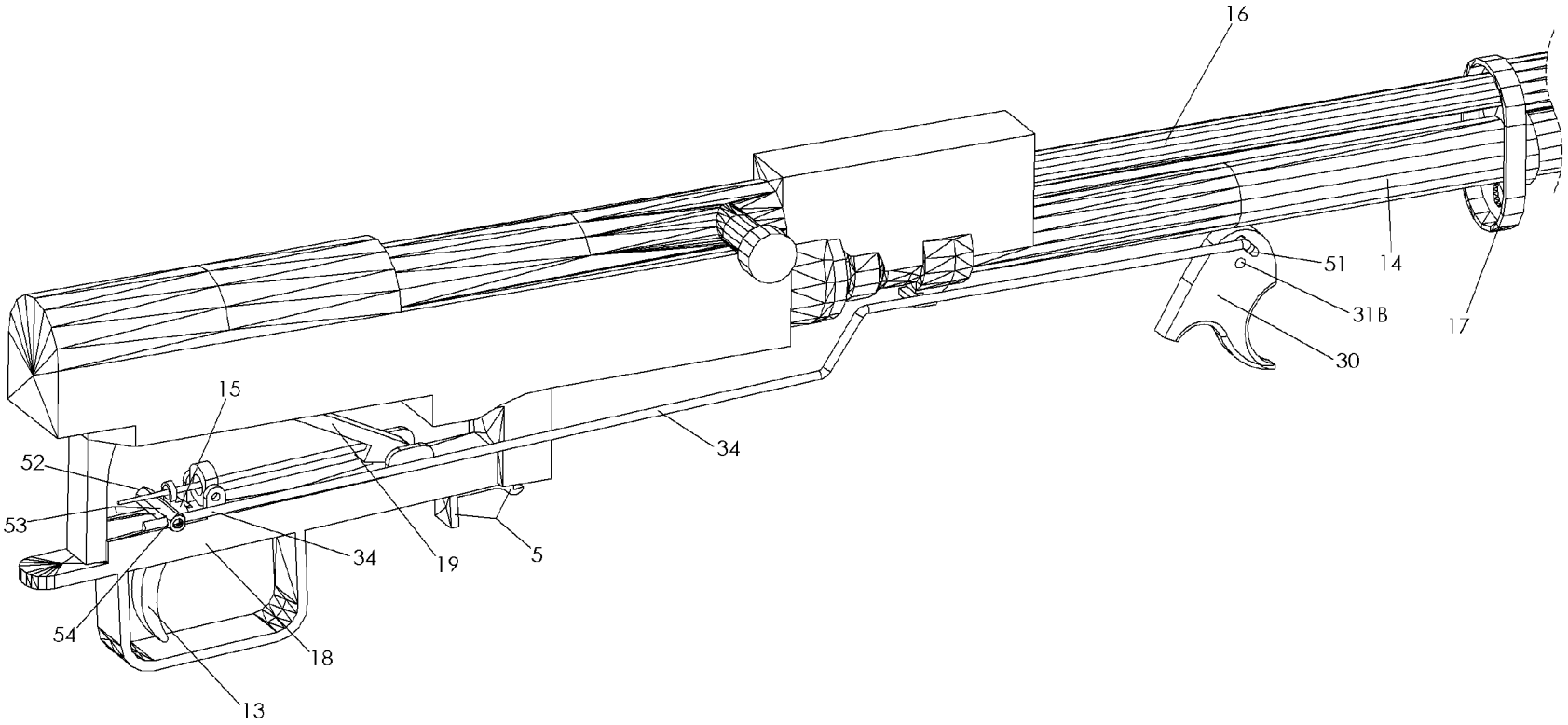
FIG. 18 is a side perspective view of the barreled action 11 used with the preferred embodiment of the invention shown in FIG. 1, also shown is the trigger and trigger link.

FIG. 18 shows a view of the barreled action 11 used with the preferred embodiment of the herein described invention. Also shown is the trigger 30, trigger link 34 and the sear engagement member 52.

When a barreled action 11 has been mounted in the chassis 22 of the present invention, a trigger link 34 extends between the trigger 30 provided for herein and the trigger 13 of the host firearms action 18 (see FIG. 18). At its forward end, the trigger link 34 has a bend 51 which is received within a thru-bore 31A of the trigger 30 (see FIGS. 13-14 and 18). The trigger link 34 extends rearwardly from the trigger 30 towards the host firearms action 18. The rearward end of the trigger link 34 is received within a thru-bore 54 located at one end of a sear engagement member 52, or engagement member. When assembled therewith, the engagement member 52 extends perpendicular to the longitudinal axis of trigger link's 34 rearward end. The engagement member 52 has a generally cylindrical shape, the exterior surface of which has a plurality of flat surfaces 53 thereon (see FIG. 18).

The engagement member 52 is secured to the trigger link 34 through the use of a set screw (not shown). A bore (not shown) is off set from the thru-bore 54 and threaded. This threaded bore receives a set screw which when tighten into place comes into direct contact with the trigger link 34. While the set screw is in contact with the trigger link 34 the engagement member 52 is unable to move. This method of assembly allows for the precise placement of the engagement member 52 during installation.

The bullpup stock kit 20 is installed on a barreled action as follows. Initially the handguard cap adaptor 70 and the magazine release lever 60 are installed on the body portion 24 of the chassis 22 as described above. Then the spring 33 and trigger safety 32 are inserted within the hollow 38 of the pistol grip 25 (see FIGS. 16-17). The thru-bore 39 of the trigger safety 32 is aligned with opening 36 of the body portion 24. A friction pin is used to secure the trigger safety 32 and spring 33 into place within the hollow 38 of the body portion 24.

The bend 51 of the trigger link 34 is now inserted into thru-bore 31A of the trigger 30. The trigger 30 is then inserted into the opening formed between the two walls which define its mounting position 37 within the body portion 24 of the chassis (see FIG. 5). The trigger 30 is secured in place through the use of a roll pin which is inserted through opening 35 of the body portion and opening 31B of the trigger 30 (see FIGS. 1-2 and 15).

Next, the barreled action 11 is positioned above the body portion 24 of the chassis 22. Then the sear engagement member 52 is installed on the trigger link 34 as described above (see FIG. 18). The engagement member 60 is positioned on the trigger link 34 so that a portion of its exterior 53 is positioned behind the sear 15 of the action 18 when inserted therein. While the engagement member 60 is so positioned, the length of the trigger link 34 runs parallel to the longitudinal axis of the barreled action 11.

The barreled action 11 is then inserted into the channel 23 of the body portion 22 so that the protruding lip 71 of the handguard cap adaptor 70 is received within the lower portion of the handguard cap 17 (see FIGS. 16-17). Next, the top portion of the chassis 22 is placed over the top of the barreled action 11. The top portion 26 is positioned so that the protruding lip 81 on its front end is received within a portion of the handguard cap 17 (see FIGS. 1-2 and 15-17). The action 18 is received within the interior opening 82 of the top portion 26. The arms 91A and 91B of the buttstock portion 28 are inserted into the opening formed between the top portion 26 and the body portion 24. When properly installed, openings 92A and 92B of the buttstock portion 28 are in alignment with opening 84 of the top portion 26. A pin is inserted through these aligned openings to secure the buttstock portion 28 to the top portion 26. Concurrently, the thru-bore 94 of the buttstock portion 28 is also in alignment with the thru-bore 42 of the body portion 24. A screw or friction pin is then inserted into the aligned thru-bores 42 and 94, effectively securing the buttstock portion 28 to the body portion 24.

To remove the bullpup stock kit 20 described above, simply reverse the above outlined steps.

When the trigger 30 is pulled to the rear the trigger link 34 is pulled forward. The forward movement of the trigger link 34 causes the engagement member 54 is push against the back side of the sear 15 of the action 18. Once sufficient pressure has been applied to the sear 15, the hammer 19 is released allowing the bullpup 10 to fire in a manner well know throughout the prior art.

Use of the magazine releaser lever 60 has been described in detail above.

The magazine release lever 60, trigger 30, trigger safety 32, handguard 21 and the body portion 24, buttstock portion 28 and top portion 26 of the chassis 22 are manufactured from nylon sixty six. While nylon sixty six is the preferred material, any material suitable for use with firearms may be substituted. All of these components are preferably manufactured through an injection molding process.

The exact shape and textures of the chassis's 22 exterior surfaces may be varied without departing from the scope of the invention disclosed herein.

In an alternate embodiment, the rotatable handguard 21 could be omitted entirely without departing from the scope of the present invention. In lieu of the rotatable handguard 21, a non-moving handguard or a fixed position vertical foregrip could replace it.

In still another alternate embodiment, iron sights could be provided as part of the top portion 26 of the chassis 22 without departing from the scope of the present invention.

The foregoing descriptions and drawings should be considered as illustrative only of the general principles of the invention. This invention is not limited for use with the barreled actions of SKS types rifles; rather it may be used with any rifles barreled action which has a similar sear 15 mechanism. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A bullpup chassis assembly for use with the barreled action of a firearm, the chassis assembly comprising:

a body portion having a channel therein configured to receive at least a portion of a barreled action, a pistol grip, and a magazine well;

a trigger rotatably mounted to said body portion in front of said magazine well and adjacent said pistol grip, said trigger further comprising a rearwardly extending trigger link configured to place said trigger into operational contact with a sear of the barreled action; and an adaptor configured to be received within said channel of said body portion, said adaptor having a protruding lip on one end configured to be received within a portion of a handguard cap of the barreled action.

2. The bullpup chassis as set forth in claim 1, further comprising a magazine release lever having a first contact surface, said first contact surface is located on a first side of said magazine release lever adjacent a top side thereof, wherein said first contact surface is configured to release a magazine seated within said magazine well when said first contact surface is depressed rearwardly away from a muzzle end of the barreled action.

3. The bullpup chassis as set forth in claim 2, wherein said magazine release lever includes a second contact surface located on a second side of said magazine release lever adjacent a bottom side thereof, wherein said second contact surface is configured to release a magazine seated within said magazine well when said second contact surface is pushed forward towards the muzzle end of the barreled action.

4. The bullpup chassis as set forth in claim 1, further comprising a trigger safety having at least one contact surface thereon, said trigger safety is positioned within said pistol grip such that said contact surface extends from an opening in a front side of said pistol grip.

5. The bullpup chassis as set forth in claim 4, wherein said trigger safety is moveable between a first position of operation and a second position of operation, wherein said first position of operation places said trigger safety into operational contact with said trigger thereby preventing the rearward movement thereof and said second position of operation removes said trigger safety from operational contact with said trigger.

6. The bullpup chassis as set forth in claim 1, wherein said trigger link includes a sear engagement member, said sear engagement member is secured about a rearward end of the trigger link and extends therefrom at an angle perpendicular to the longitudinal axis of said trigger link.

7. The bullpup chassis as set forth in claim 1, wherein said adaptor is removably secured within said channel of said body portion.

8. A stock set for converting a rifle into bullpup configuration, the stock set comprising:

a body portion having a channel therein configured to receive at least a portion of a rifle, a magazine well, and a pistol grip;

a top portion having a lip protruding from a front end thereof, said lip is configured to be received within a portion of a handguard cap of the rifle;

an adaptor configured to be received within said channel of said body portion, said adaptor having a protruding lip on one end configured to be received within a portion of the handguard cap of the rifle; and a trigger pivotally mounted to said body portion, said trigger further comprising a rearwardly extending trigger link having a sear engagement member extending therefrom, said sear engagement member is positioned on the trigger link so it may be received within an action of the rifle thereby placing said trigger into operational contact with a sear of the rifle.

9. The stock set of claim 8, further comprising a magazine release lever, said magazine release lever includes a thru-bore located adiacent a center thereof configured to receive a pin about which said magazine release lever rotates.

10. The stock set of claim 9, wherein said magazine release lever includes a first contact surface, said first contact surface is located on a first side of said magazine release adjacent a top side thereof, wherein said first contact surface is configured to release a magazine seated within said magazine well when said first contact surface is depressed rearwardly away from a muzzle end of the rifle.

11. The stock set of claim 10, wherein said magazine release lever includes a second contact surface located on a second side of said magazine release lever adjacent a bottom side thereof, wherein said second contact surface is configured to release a magazine seated within said magazine well when said second contact surface is pushed forward towards the muzzle end of the rifle.

12. The stock set of claim 8, further comprising a trigger safety having an engagement surface, said trigger safety is moveable between a first position of operation and a second position of operation, wherein said first position of operation places said engagement surface into operational contact with a protruding member of said trigger thereby preventing the rearward movement of said trigger and said second position of operation removes said engagement surface from operational contact with said protruding member of said trigger.

13. The stock set of claim 8, wherein the action of the rifle also includes a hammer and a firing pin, said sear engagement member is located adjacent the sear and in operational communication therewith such that when said trigger is pulled rearwardly said sear engagement member pulls the sear forward, the forward movement of the sear releasing the hammer to strike the firing pin.

14. A bullpup configured rifle comprising:

a barreled action of an autoloading rifle including at least a sear, a hammer, a bolt, a firing pin, a receiver, a barrel, and a handguard cap;

a stock set comprising a body portion, a top portion, and a buttstock portion;

a handguard cap adaptor having a protruding lip on one end, said lip is configured to be received within a portion of the handguard cap of the rifle said body portion comprising a pistol grip extending from a bottom surface thereof, a channel configured to receive therein a portion of the barreled action, a magazine well, and a pocket located within said channel configured to receive therein said handguard cap adaptor;

a trigger mounted on said body portion having a rearwardly extending trigger link, said trigger link having a sear engagement member extending therefrom in operational contact with the sear of the barreled action, wherein when said trigger is pulled rearwardly said trigger link moves longitudinally alongside the barreled action of the firearm causing said sear engagement member to push against the sear thereby releasing the hammer to strike the firing pin; and a magazine release lever having a thru-bore configured to receive a pin about which said magazine release lever pivots.

15. The bullpup configured rifle of claim 14, wherein said magazine release lever includes a first contact surface and a second contact surface positioned on opposite sides of said thru-bore, said first contact surface is located on a first side of said magazine release lever adjacent a top side thereof, wherein said first contact surface is configured to release a magazine seated within said magazine well when said first contact surface is depressed rearwardly away from a muzzle end of the rifle, said second contact surface is located on a second side of said magazine release lever adjacent a bottom side thereof, wherein said second contact surface is configured to release a magazine seated within said magazine well when said second contact surface is pushed forward towards the muzzle end of the rifle.

16. The bullpup configured rifle of claim 14, said handguard cap adaptor is removably secured within said pocket.

17. The bullpup configured rifle of claim 14, said sear engagement member is provided with a means to secure the sear engagement member to said trigger link.

18. The bullpup configured rifle of claim 14, further comprising a trigger safety having at least one contact surface thereon, said trigger safety is positioned within said pistol grip such that said contact surface extends from an opening in a front side of said pistol grip.

19. The bullpup configured rifle of claim 18, wherein said trigger safety also includes an engagement surface, said trigger safety is moveable between a first position of operation and a second position of operation, wherein said first position of operation places said engagement surface into operational contact with a protruding member of said trigger thereby preventing the rearward movement of said trigger and said second position of operation removes said engagement surface from operational contact with said protruding member of said trigger.

20. The bullpup configured rifle of claim 14, said body portion also includes a rotatable handguard that is secured to said body portion in front of said trigger, said rotatable handguard is configured to move between at least a first position and a second position, wherein said second position places said rotatable handguard into a vertical position relative to the longitudinal axis of said body portion.

* * * * *